US011657933B2

(12) United States Patent
Choi et al.

(10) Patent No.: US 11,657,933 B2
(45) Date of Patent: May 23, 2023

(54) MANUFACTURING METHOD OF SINTERED MAGNET, AND SINTERED MAGNET

(71) Applicant: LG Chem, Ltd., Seoul (KR)

(72) Inventors: Ikjin Choi, Daejeon (KR); Jung Goo Lee, Daejeon (KR); Juneho In, Daejeon (KR); Soon Jae Kwon, Daejeon (KR); Hyounsoo Uh, Daejeon (KR); Jinhyeok Choe, Daejeon (KR); Ingyu Kim, Daejeon (KR); Eunjeong Shin, Daejeon (KR)

(73) Assignee: LG Chem, Ltd.

( * ) Notice: Subject to any disclaimer, the term of this patent is extended or adjusted under 35 U.S.C. 154(b) by 665 days.

(21) Appl. No.: 16/614,426

(22) PCT Filed: Nov. 28, 2018

(86) PCT No.: PCT/KR2018/014849
§ 371 (c)(1),
(2) Date: Nov. 18, 2019

(87) PCT Pub. No.: WO2019/107929
PCT Pub. Date: Jun. 6, 2019

(65) Prior Publication Data

US 2020/0203068 A1 Jun. 25, 2020

(30) Foreign Application Priority Data

Nov. 28, 2017 (KR) ..... 10-2017-0160623
Nov. 6, 2018 (KR) ..... 10-2018-0135441

(51) Int. Cl.

| | |
|---|---|
| ***H01F 1/057*** | (2006.01) |
| ***B22F 3/10*** | (2006.01) |
| ***C22C 38/00*** | (2006.01) |
| ***C22C 38/16*** | (2006.01) |
| ***H01F 41/02*** | (2006.01) |
| ***B22F 1/142*** | (2022.01) |

(52) U.S. Cl.
CPC ..... *H01F 1/0572* (2013.01); *B22F 1/142* (2022.01); *B22F 3/10* (2013.01); *C22C 38/002* (2013.01); *C22C 38/005* (2013.01); *C22C 38/16* (2013.01); *H01F 1/057* (2013.01); *H01F 1/0577* (2013.01); *H01F 41/0293* (2013.01); *B22F 2301/355* (2013.01); *C22C 2202/02* (2013.01)

(58) Field of Classification Search
None
See application file for complete search history.

(56) References Cited

U.S. PATENT DOCUMENTS

| | | | | |
|---|---|---|---|---|
| 4,767,450 | A * | 8/1988 | Ishigaki | C22C 38/00 420/83 |
| 4,853,045 | A * | 8/1989 | Rozendaal | H01F 1/0573 419/33 |
| 6,051,047 | A | 4/2000 | Zhou et al. | |
| 6,444,052 | B1 * | 9/2002 | Honkura | C22C 38/005 148/101 |
| 6,447,621 | B1 | 9/2002 | Tokoro et al. | |
| 6,599,465 | B1 | 7/2003 | Reppel et al. | |
| 2002/0144754 | A1 | 10/2002 | Tokoro et al. | |
| 2012/0182109 | A1 | 7/2012 | Ozeki et al. | |
| 2012/0299675 | A1 | 11/2012 | Honkura et al. | |
| 2014/0366687 | A1 | 12/2014 | Zakotnik et al. | |
| 2015/0071810 | A1 * | 3/2015 | Lv | C22C 38/16 419/23 |
| 2015/0187494 | A1 | 7/2015 | Lee et al. | |
| 2015/0302961 | A1 | 10/2015 | Lee et al. | |
| 2016/0118169 | A1 * | 4/2016 | Zakotnik | H01F 41/0266 148/302 |
| 2016/0225522 | A1 | 8/2016 | Zakotnik et al. | |
| 2016/0260530 | A1 | 9/2016 | Yue et al. | |
| 2019/0139686 | A1 * | 5/2019 | Kim | H01F 41/0266 |
| 2019/0292635 | A1 | 9/2019 | In et al. | |

FOREIGN PATENT DOCUMENTS

| | | | |
|---|---|---|---|
| CN | 101996721 | A | 3/2011 |
| CN | 104036946 | A | 9/2014 |
| CN | 104036948 | A | 9/2014 |
| CN | 105304252 | A | 2/2016 |
| CN | 106710768 | A | 5/2017 |

(Continued)

OTHER PUBLICATIONS

Extended European Search Report including Written Opinion for Application No. EP18884237.1 dated Apr. 6, 2020, pp. 1-9.

(Continued)

*Primary Examiner* — George Wyszomierski
(74) *Attorney, Agent, or Firm* — Lerner David LLP

(57) ABSTRACT

A sintered magnet and method of manufacturing the same are disclosed herein. According to an exemplary embodiment, a manufacturing method of a sintered magnet includes mixing the neodymium iron boron (NdFeB)-based powders and rare-earth hydride powders to prepare a mixture, heat-treating the mixture at a temperature of 600 to 850° C., and sintering the heat-treated mixture at a temperature of 1000 to 1100° C. to prepare the sintered magnet, wherein the rare earth hydride powders are neodymium hydride ($NdH_2$) powders or mixed powers of $NdH_2$ and praseodymium hydride ($PrH_2$). In an embodiment, the NdFeB-based powders are prepared by a reduction-diffusion method.

8 Claims, 12 Drawing Sheets

(56) References Cited

FOREIGN PATENT DOCUMENTS

| | | | |
|---|---|---|---|
| EP | 3090821 | A1 | 11/2016 |
| JP | H04120238 | A | 4/1992 |
| JP | H04221805 | A | 8/1992 |
| JP | 2000054011 | A | 2/2000 |
| JP | 2000223306 | A | 8/2000 |
| JP | 2002540595 | A | 11/2002 |
| JP | 2011146645 | A | 7/2011 |
| JP | 2015008231 | A | 1/2015 |
| JP | 2016082176 | A | 5/2016 |
| JP | 2016532287 | A | 10/2016 |
| KR | 950013979 | B1 | 11/1995 |
| KR | 19980086499 | A | 12/1998 |
| KR | 20120116116 | A | 10/2012 |
| KR | 101354138 | B1 | 1/2014 |
| KR | 101534717 | B1 | 7/2015 |
| KR | 101548684 | B1 | 9/2015 |
| KR | 20170034024 | A | 3/2017 |
| KR | 20170049538 | A | 5/2017 |
| KR | 20180051224 | A | 5/2018 |
| WO | 2011070827 | A1 | 6/2011 |
| WO | 2016025792 | A1 | 2/2016 |

OTHER PUBLICATIONS

International Search Report for PCT/KR2018/014849 dated Mar. 11, 2019.

* cited by examiner

MANUFACTURING METHOD OF SINTERED MAGNET, AND SINTERED MAGNET

CROSS-REFERENCE WITH RELATED APPLICATION(S)

The present application is a national phase entry under 35 U.S.C. § 371 of International Application No. PCT/KR2018/014849, filed on Nov. 28, 2018, which claims priority from Korean Patent Application No. 10-2017-0160623, filed on Nov. 28, 2017, and Korean Patent Application No. 10-2018-0135441, filed on Nov. 6, 2018, the contents of which are incorporated by reference herein.

FIELD OF THE INVENTION

The present invention relates to a sintered magnet and a manufacturing method thereof. More particularly, the present invention relates to a manufacturing method of a sintered magnet, which is performed by adding a rare earth hydride as a sintering aid to a NdFeB-based alloy powder prepared by a reduction-diffusion method, and an NdFeB-based sintered magnet manufactured by such a method.

BACKGROUND OF THE INVENTION

A NdFeB-based magnet, which is a permanent magnet having a composition of a compound ($Nd_2Fe_{14}B$) of neodymium (Nd) as a rare earth element, iron (Fe), and boron (B), has been used as a universal permanent magnet for 30 years since its development in 1983. Such NdFeB-based magnets are used in various fields such as electronic information, automobile industry, medical equipment, energy, and transportation. Particularly, they are used in products such as machine tools, electronic information devices, household electric appliances, mobile phones, robot motors, wind power generators, small motors for automobiles, and driving motors in accordance with the recent lightweight and miniaturization trend.

The general manufacture of NdFeB-based magnets is known as a strip/mold casting or melt spinning method based on a metal powder metallurgy method. First, in the case of the strip/mold casting method, it is a process of melting a metal such as neodymium (Nd), iron (Fe), or boron (B) by heating to produce an ingot, and coarsely pulverized particles of crystal grains to form microparticles through a micronization step. This process is repeated to obtain powders, which are subjected to a pressing process and a sintering process under a magnetic field to manufacture an anisotropic sintered magnet.

In addition, a melt spinning method is a method in which metal elements are melted and then poured into a wheel rotating at a high speed to quench, jet milled, and then blended with a polymer to form a bonded magnet, or pressed to manufacture a magnet.

However, all of these methods require a pulverization process, require a long time in the pulverization process, and require a process to coat surfaces of the powders after pulverization.

The above information disclosed in this Background section is only for enhancement of understanding of the background of the invention and therefore it may contain information that does not form the prior art that is already known in this country to a person of ordinary skill in the art.

SUMMARY OF THE INVENTION

The present disclosure has been made in an effort to provide an NdFeB-based sintered magnet having improved compactness by preventing main phase decomposition of the NdFeB-based sintered magnet by mixing rare earth hydride powders and NdFeB-based alloy powders prepared by a solid-phase reduction-diffusion method, and heat-treating them.

An exemplary embodiment of the present invention provides a manufacturing method of a sintered magnet, including: preparing NdFeB-based powders by using a reduction-diffusion method; mixing the NdFeB-based powders and rare-earth hydride powders; heat-treating the mixture at a temperature of 600 to 850° C.; and sintering the heat-treated mixture at a temperature of 1000 to 1100° C., wherein the rare earth hydride powders are $NdH_2$ powders or mixed powers of $NdH_2$ and $PrH_2$.

A mixing weight ratio may be in a range of 75:25 to 80:20 in the mixed powers of $NdH_2$ and $PrH_2$. The sintering of the heat-treated mixture at the temperature of 1000 to 1100° C. may be performed for 30 min to 4 h.

A content of the rare earth hydride powders may be in a range of 1 to 25 wt % in the mixing of the NdFeB-based powders and the rare-earth hydride powders.

A size of the crystal grains of the manufactured sintered magnet may be 1 to 10 μm.

A rare earth hydride may be separated into a rare earth metal and $H_2$ gas, and the $H_2$ gas may be removed in the heat-treating of the mixture at the temperature of 600 to 850° C.

Cu powders may be further contained in the mixing of the NdFeB-based powders and the rare-earth hydride powders.

A content ratio of the rare earth hydride powders and the Cu powders may be 7:3 by weight.

The preparing of the NdFeB-based powders by using the reduction-diffusion method may include: preparing a first mixture by mixing a neodymium oxide, boron, and iron; preparing a second mixture by adding calcium to the first mixture and mixing them; and heating the second mixture to a temperature of 800 to 1100° C.

According to an exemplary embodiment of the present invention, a sintered magnet may be manufactured by using steps of: preparing NdFeB-based powders by using a reduction-diffusion method; mixing the NdFeB-based powders and rare-earth hydride powders; heat-treating the mixture at a temperature of 600 to 850° C.; and sintering the heat-treated mixture at a temperature of 1000 to 1100° C.

According to the exemplary embodiment of the present invention, the sintered magnet may contain $Nd_2Fe_{14}B$, a size of the crystal grains thereof may be in a range of 1 to 10 μm, and a content of the rare earth hydride powders may be in a range of 1 to 25 wt %.

As described above, according to the present exemplary embodiment, it is possible to manufacture a NdFeB-based sintered magnet having improved compactness by preventing main phase decomposition of NdFeB-based alloy powders by mixing rare earth hydride powders and the NdFeB-based alloy powders prepared by a solid-phase reduction-diffusion method, and heat-treating them.

DETAILED DESCRIPTION OF THE EMBODIMENTS

Figure 1:
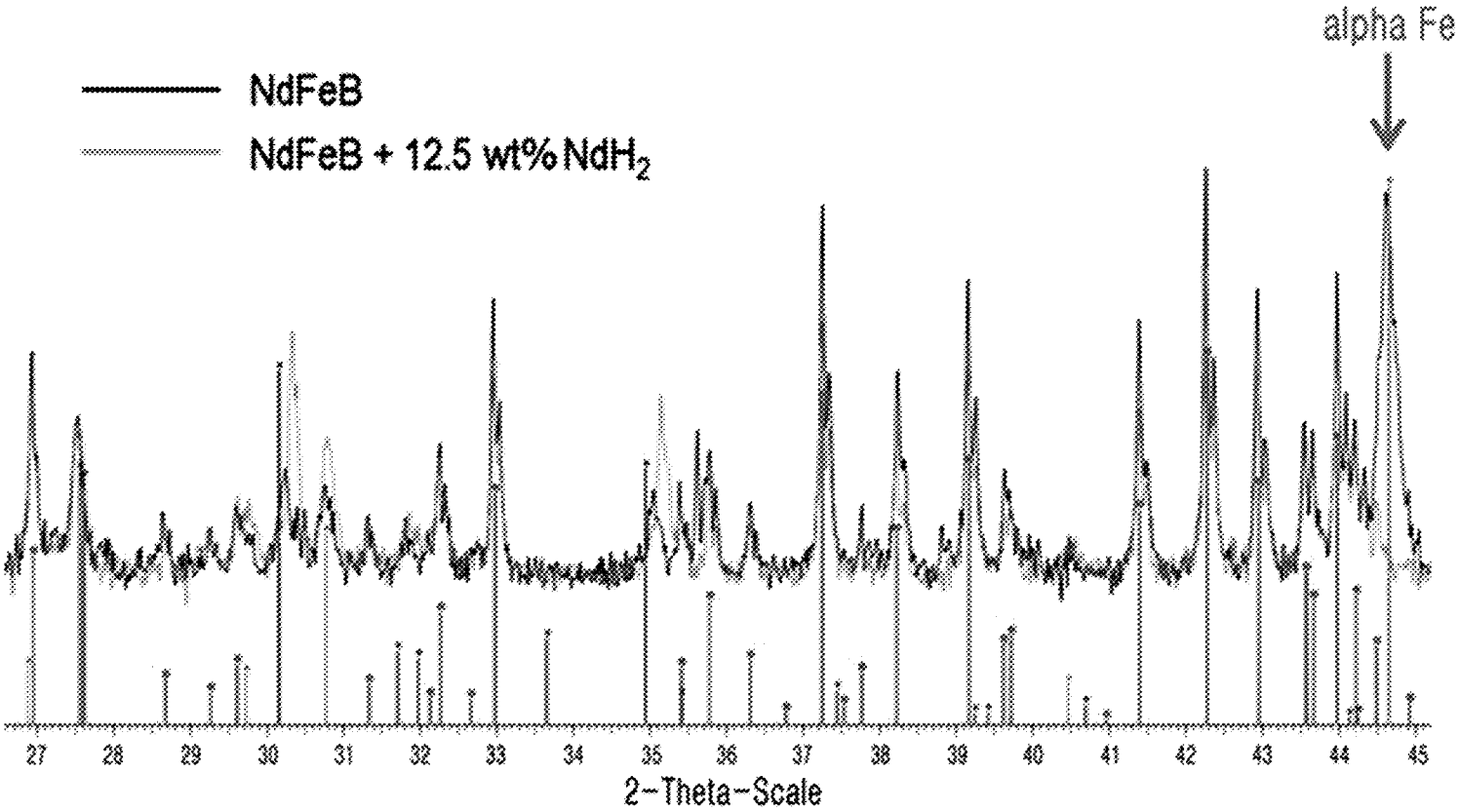
FIG. 1 illustrates XRD patterns of a sintered magnet manufactured in Example 3 (gray line, $NdH_2$ of 12.5 wt %) and a sintered magnet (black line) manufactured in Comparative Example 3.

A method of manufacturing a sintered magnet according to an embodiment of the present invention will now be described in detail. The manufacturing method of the sintered magnet according to the present exemplary embodiment may be a manufacturing method of a $Nd_2Fe_{14}B$ sintered magnet. That is, the manufacturing method of the sintered magnet according to the present exemplary embodiment may be a manufacturing method of a $Nd_2Fe_{14}B$-based sintered magnet. The $Nd_2Fe_{14}B$ sintered magnets is a permanent magnet, and may be referred to as a neodymium magnet.

The manufacturing method of the sintered magnet according to the present disclosure includes: preparing NdFeB-based powders by using a reduction-diffusion method; mixing the NdFeB-based powders and rare-earth hydride powders; heat-treating the mixture at a temperature of 600 to 850° C.; and sintering the heat-treated mixture at a temperature of 1000 to 1100° C., The rare earth hydride powders are $NdH_2$ powders or mixed powers of $NdH_2$ and $PrH_2$.

In this case, the sintering of the heat-treated mixture at the temperature of 1000 to 1100° C. may be performed for 30 min to 4 h.

In the manufacturing method of the sintered magnet according to the present disclosure includes, the NdFeB-based powders are formed by using a reduction-diffusion method. Therefore, a separate pulverization process such as coarse pulverization, hydrogen pulverization, and jet milling, or a surface treatment process, is not required. Further, the NdFeB-based powders prepared by the reduction-diffusion method was mixed with rare-earth hydride powders ($NdH_2$ powders or mixed powers of $NdH_2$ and $PrH_2$) to be heat-treated and sintered to thereby form a Nd-rich region and a $NdO_x$ phase at grain boundaries of the NdFeB-based powders and the main phase grains. In this case, x may be in a range of 1 to 4. Therefore, when the sintered magnet is manufactured by sintering magnet powders according to the present embodiment, decomposition of main phase particles during a sintering process can be suppressed.

Hereinafter, each step will be described in more detail.

First, the preparing of the NdFeB-based powders by using the reduction-diffusion method will be described. The preparing of the NdFeB-based powders by using the reduction-diffusion method may include: preparing a first mixture by mixing a neodymium oxide, boron, and iron; preparing a second mixture by adding calcium to the first mixture and mixing them; and heating the second mixture to a temperature of 800 to 1100° C.

The manufacturing method is a method of mixing source materials such as a neodymium oxide, boron, and iron, and forming $Nd_2Fe_{14}B$ alloy powders at a temperature of 800 to 1100° C. by reduction and diffusion of the source materials. Specifically, a molar ratio of the neodymium oxide, the boron, and the iron may be between 1:14:1 and 1.5:14:1 in the mixture of the neodymium oxide, the boron, and the iron. Neodymium oxide, boron, and iron are source materials used for preparing $Nd_2Fe_{14}B$ metal powders, and when the molar ratio is satisfied, $Nd_2Fe_{14}B$ alloy powder may be prepared with a high yield. When the mole ratio is 1:14:1 or less, main phase decomposition of NdFeB may occur and no Nd-rich grain boundary phase may be formed, and when the molar ratio is 1.5:14:1 or more, reduced Nd remains due to the excess of an Nd amount, and the remaining Nd in a post-treatment is changed to $Nd(OH)_3$ or $NdH_2$.

The heating of the mixture to the temperature of 800 to 1100° C. may be performed for 10 min to 6 h under an inactive gas atmosphere. When the heating time is less than 10 min, the metal powders may not be sufficiently synthesized, and when the heating time is more than 6 h, a size of the metal powders becomes large and primary particles may aggregate.

The metal powder thus prepared may be $Nd_2Fe_{14}B$. In addition, a size of the metal powders prepared may be in a range of 0.5 to 10 μm. In addition, the size of the metal powders prepared according to an exemplary embodiment may be in a range of 0.5 to 5 μm.

As a result, $Nd_2Fe_{14}B$ alloy powders are prepared by heating the source materials at the temperature of 800 to 1100° C., and the $Nd_2Fe_{14}B$ alloy powders become a neodymium magnet and exhibit excellent magnetic properties. Typically, for preparing the $Nd_2Fe_{14}B$ alloy powders, the source materials is melted at a high temperature of 1500 to 2000° C. and then quenched to form a source material mass, and this mass is subjected to coarse pulverization and hydrogen pulverization to obtain the $Nd_2Fe_{14}B$ alloy.

However, such a method requires the high temperature for melting the source materials, and requires a process of cooling and then pulverizing the source materials, and thus the process time is long and complicated. Further, the coarse-pulverized $Nd_2Fe_{14}B$ alloy powders require a separate surface treatment process in order to enhance corrosion resistance and to improve electrical resistance and the like.

However, when the NdFeB-based powders are prepared by the reduction-diffusion method as in the present exemplary embodiment, the $Nd_2Fe_{14}B$ alloy powders are prepared by the reduction and diffusion of the source materials at the temperature of 800 to 1100° C. In this case, a separate pulverizing process is not necessary since the size of the alloy powders is formed at several micrometers. More specifically, the size of the metal powders prepared in the present exemplary embodiment may be in a range of 0.5 to 10 μm. Particularly, the size of the alloy powders prepared may be controlled by controlling a size of the iron powders used as the source material.

However, when the magnet powders are prepared by the reduction-diffusion method, calcium oxide, which is a by-product produced in the manufacturing process, is formed and a process for removing the calcium oxide is required. In order to remove the calcium oxide, the prepared magnet powders may be washed using distilled water or a basic aqueous solution. The prepared magnet powder particles are exposed to oxygen in the aqueous solution in this cleaning process such that surface oxidation of the prepared magnet powder particles by the oxygen remaining in the aqueous solution is performed, to form an oxide coating on the surface thereof.

This oxide coating makes it difficult to sinter the magnet powders. In addition, a high oxygen content accelerates main phase decomposition of the magnetic particles, thereby deteriorating the physical properties of the permanent magnet. Therefore, it is difficult to manufacture a sintered magnet using reduction-diffusion magnet powders having a high oxygen content.

However, the manufacturing method according to an exemplary embodiment of the present invention improves sinterability of the manufactured sintered magnet and suppresses main phase decomposition by mixing the rare earth hydride powders with the NbFeB-based powders prepared by using the reduction-diffusion method, and heat-treating and sintering the mixture to form Nd-rich regions and $NdO_x$ phases at grain boundaries inside the sintered magnet or grain boundary regions of the main phase grains of the sintered magnet. As a result, a high-density sintered permanent magnet having an Nd-rich grain boundary phase may be manufactured.

Next, the NdFeB-based powders and the rare-earth hydride powders are mixed. In the step, a content of the rare earth hydride powders may be in a range of 1 to 25 wt %.

The rare earth hydride may contain single powders, and may be a mixture of different powders. For example, the rare earth element hydride may contain single $NdH_2$. Alternatively, the rare earth hydride may be mixed powders of $NdH_2$ and $PrH_2$. When the rare earth hydride is the mixed powders of $NdH_2$ and $PrH_2$, a mixing weight ratio may be in a range of 75:25 to 80:20.

When the content of the rare earth hydride powders is less than 1 wt %, sufficient wetting may not occur between the particles as a liquid phase sintering aid, so that the sintering may not be performed well and the NdFeB main phase decomposition may not be sufficiently suppressed. When the content of the rare earth hydride powders is more than 25 wt %, a volume ratio of the NdFeB main phase in the sintered magnet may decrease, a residual magnetization value may decrease, and the particles may be excessively grown by the liquid phase sintering. When a size of the crystal grains increases due to overgrowth of the particles, the coercive force is reduced because it is vulnerable to magnetization reversal.

Preferably, the content of the rare earth hydride powders may be in a range of 3 to 10 wt %.

Next, the mixture is heat-treated at a temperature of 600 to 850° C. In this step, the rare earth hydride is separated into a rare earth metal and hydrogen gas, and the hydrogen gas is removed. For example, when the rare-earth hydride powders are $NdH_2$, $NdH_2$ is separated into Nd and $H_2$ gases, and the $H_2$ gas is removed. In other words, heat treatment at 600 to 850° C. is a process of removing hydrogen from the mixture. In this case, the heat treatment may be performed in a vacuum atmosphere.

Next, the heat-treated mixture is sintered at a temperature of 1000 to 1100° C. In this case, the sintering of the heat-treated mixture at the temperature of 1000 to 1100° C. may be performed for 30 min to 4 h. This sintering process may also be performed in a vacuum atmosphere. In this sintering step, liquid sintering by Nd is induced. Specifically, the liquid sintering by Nd occurs between the NdFeB-based powder prepared by the conventional reduction-diffusion method and the added rare earth hydride $NdH_2$ powders, and Nd-rich regions and $NdO_x$ phases are formed at grain boundaries inside the sintered magnet or grain boundary regions of the main phase grains of the sintered magnet. The thus formed Nd-rich regions or $NdO_x$ phases prevent the decomposition of the main phase particles in the sintering process for manufacturing the sintered magnet. Accordingly, a sintered magnet may be stably manufactured.

The manufactured sintered magnet may have a high density, and the size of the crystal grains may be in a range of 1 to 10 μm.

As such, in the sintered magnet according to the exemplary embodiment of the present invention, Nd-rich regions and $NdO_x$ phases are formed at grain boundaries of the NdFeB-based powders or grain boundaries of the main phase grains by mixing the rare earth hydride powders with the NbFeB-based powders prepared by using the reduction-diffusion method, and heat-treating and sintering the mixture. These Nd-rich regions and $NdO_x$ phases may improve sinterability of magnet powders and suppress decomposition of main phase particles during the sintering process.

A size of the crystal grains of the manufactured sintered magnet may be 1 to 10 μm. In such a sintered magnet, a Nd-rich region or a $NdO_x$ phase may be formed. Accordingly, when a magnet is manufactured by sintering magnet powders, it is possible to prevent main phase decomposition inside the sintered magnet.

Hereinafter, a manufacturing method of the sintered magnet according to an exemplary embodiment of the present invention will be described.

Example 1: Formation of NdFeB-Based Magnet Powders 3.2000 g of $Nd_2O_3$, 0.1 g of B, 7.2316 g of Fe, and 1.75159 g of Ca are uniformly mixed with metal fluorides $CaF_2$ and $CuF_2$ for controlling fineness numbers and sizes of particles thereof. They are contained in a stainless steel container having any shape to be compressed, and then the mixture is reacted in a tube electric furnace at a temperature of 950° C. in an inert gas (Ar, He, or the like) atmosphere for 0.5 to 6 h.

Next, the reaction product is ground in a mortar to separate it into fine particles through a process of separation, and then a cleaning process is performed to remove Ca and CaO as reducing by-products. For non-aqueous cleaning, 6.5 to 7.0 g of $NH_4NO_3$ is uniformly mixed with the synthesized powders and then immersed in 200 ml or less of methanol. For effective cleaning, a homogenization and ultrasonic cleaning are alternately repeated once or twice. The cleaning process is repeated about twice with a same amount of methanol to remove $Ca(NO)_3$, which is a product of reaction between the remaining CaO and $NH_4NO_3$. The cleaning process may be repeated until clear methanol is obtained. Finally, rinsing with acetone followed by vacuum drying to complete the washing, and then single $Nd_2Fe_{14}B$ powder particles are obtained.

Example 2: Mixing with $NdH_2$ and Sintering 10 to 25% by mass of $NdH_2$ powders is mixed with 8 g of NdFeB-based powder particles ($Nd_2Fe_{14}B$) prepared by using the method described in Example 1. As a lubricant, butanol is added thereto to be subjected to magnetic field molding, and then a debinding process is carried out in a vacuum sintering furnace at 150° C. for 1 h and 300° C. for 1 h. Next, a heat treatment process is performed at 650° C. for 1 h as a dehydrogenation process, and a sintering process is performed at 1050° C. for 1 h.

Example 3: 12.5 wt % of $NdH_2$ Used as a Sintering Aid

In Example 2, 12.5 wt % of $NdH_2$ is added to manufacture a sintering magnet.

Comparative Example 1: No Sintering Aid Used

No $NdH_2$ is mixed with the NdFeB-based magnetic powders prepared in Example 1, and as a lubricant, butanol is added thereto to be subjected to magnetic field molding, and then a debinding process is carried out at 150° C. for 1 h and 300° C. for 1 h. Next, a heat treatment process is performed at 650° C. for 1 h in a vacuum sintering furnace, and a sintering process is performed at 1050° C. for 1 h.

Example 4: Mixing and Sintering Using Mixed Powder of $NdH_2$ and $PrH_2$

In order to prepare $Nd_{2.0}Fe_{13}BGa_{0.01,0.05}Al_{0.05}Cu_{0.05}$, 33.24 g of $Nd_2O_3$, 1.04 g of B, 0.40 g of $AlF_3$, 0.65 g of $CuCl_2$, and 0.12 g of $GaF_3$ are inserted into a Nalgene bottle to be mixed with a paint shaker for 30 min, then 69.96 g of Fe is inserted thereto to be mixed with a paint shaker for 30 min, and finally 16.65 g of Ca is inserted thereto to be mixed with a tubular mixer for 1 h.

Next, the mixture is inserted into a SUS tube having an interior surrounded by a carbon sheet, and is reacted at 950° C. in an inert gas (Ar or He) environment in a tube electric furnace for 10 min. The powders are inserted into ethanol containing ammonium nitrate and are cleaned for 10 to 30 min by using a homogenizer, then the cleaned powders, ethanol, zirconia balls (weight ratio of 6 times compared to the powders), and ammonium nitrate (1/10 of an amount used in the initial cleaning) are inserted, and then the powder particles are pulverized with a tubular mixer to be cleaned and dried with acetone.

10 to 12 wt % of $(Nd+Pr)H_2$ powders (powders in which $NdH_2$ and $PrH_2$ pulverized in a dried or hexane atmosphere are mixed at a ratio of 75:25 or 80:20) are added into 8 g of Nd-based powders, butanol (or Zn stearate) as a lubricant is added thereto to be subjected to magnetic field molding, and the mixture is sintered in a vacuum sintering furnace at 1030° C. for 2 h.

Example 5: Mixing and Sintering Using Single Powders of $NdH_2$

10% to 25% by mass of $NdH_2$ powders is mixed with 8 g of Nd-based powders prepared in a same manner as in Example 4, butanol as a lubricant is added thereto to be subjected to magnetic field molding, and the mixture is sintered in a vacuum sintering furnace at 1050° C. for 1 h.

Example 6: Mixing and Sintering (3%) with Different Contents of $NdH_2$

In order to prepare $Nd_{2.5}Fe_{13.3}B_{1.1}Cu_{0.05}Al_{0.15}$, 37.48 g of $Nd_2O_3$, 1.06 g of B, 0.28 g of Cu, and 0.36 g of Al are inserted into a nalgene bottle to be mixed with a paint shaker for 30 min, then 66.17 g of Fe is inserted thereto to be mixed with a paint shaker for 30 min, and finally 20.08 g of Ca is inserted thereto to be mixed with a tubular mixer for 1 h.

Next, the mixture is inserted into a SUS tube having an interior surrounded by a carbon sheet, and is reacted at 950° C. in an inert gas (Ar or He) environment in a tube electric furnace for 10 min. The powders are inserted into ethanol containing ammonium nitrate and are cleaned for 10 to 30 min by using a homogenizer, then the cleaned powders, ethanol, zirconia balls (weight ratio of 6 times compared to the powders), and ammonium nitrate (1/10 of an amount used in the initial cleaning) are inserted, and then the powder particles are pulverized with a tubular mixer to be cleaned and dried with acetone.

3 wt % of $NdH_2$ powders is added into 8 g of Nd-based powders prepared in the same manner as in Example 4, butanol as a lubricant is added thereto to be subjected to magnetic field molding, and the mixture is sintered in a vacuum sintering furnace at 1030° C. for 2 h.

Example 7: Mixing and Sintering (5%) with Different Contents of $NdH_2$ 8 g of Nd-based powders is prepared in the same manner as in Example 6. 5 wt % of $NdH_2$ powders is added into 8 g of Nd-based powders prepared in the same manner as in Example 4, butanol as a lubricant is added thereto to be subjected to magnetic field molding, and the mixture is sintered in a vacuum sintering furnace at 1030° C. for 2 h.

Evaluation Example 1

XRD patterns of the sintered magnet (gray line) manufactured in Example 3 and the sintered magnet (black line) manufactured in Comparative Example 1 are illustrated in FIG. 1. In addition, a scanning electron microscope image of the sintered magnet manufactured in Example 3 is illustrated in FIG. 2.

Referring to FIG. 1, Comparative Example 1 (black line) in which $NdH_2$ is not added shows an alpha-Fe peak caused by NdFeB main phase decomposition. However, Example 3 (orange line) in which $NdH_2$ is added does not show an alpha-Fe peak caused by NdFeB main phase decomposition. As a result, it can be seen that the NdFeB main phase decomposition of the manufactured sintered magnet is suppressed by the addition of $NdH_2$.

Figure 2:
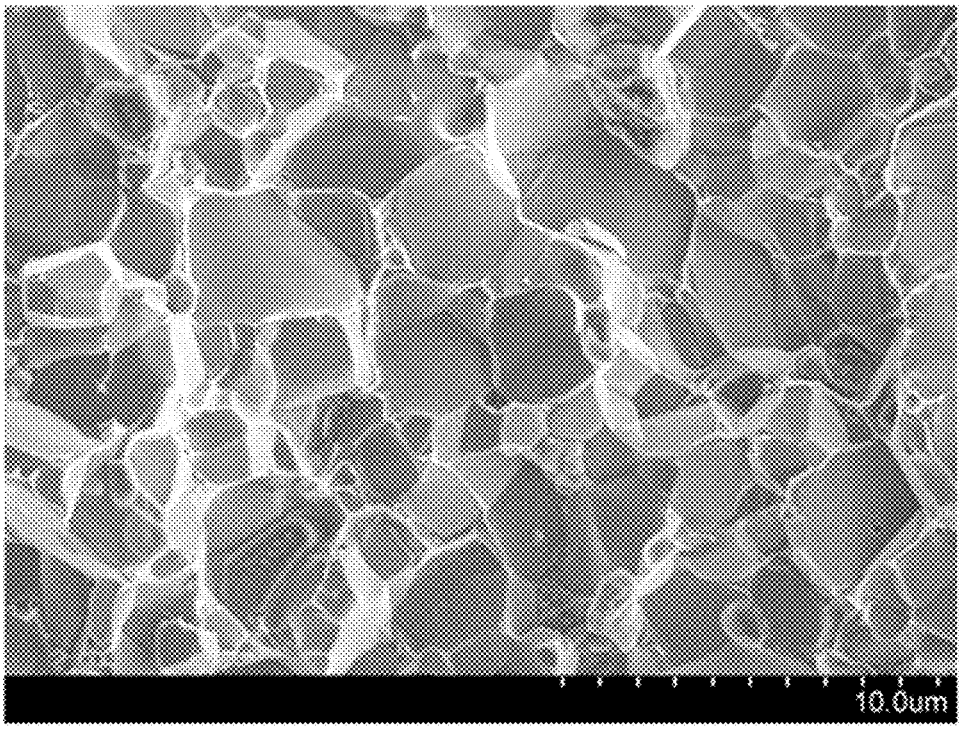
FIG. 2 illustrates a scanning electron microscope image of a sintered magnet manufactured in Example 3.

Referring to FIG. 2, it can be confirmed that the sintered magnet manufactured in Example 3 is uniformly sintered at a high density.

Through Example 2 and Comparative Example 1, a constant amount of $NdH_2$ shows the effect of suppressing the decomposition of the NdFeB main phase decomposition and imparting sinterability to improve the compactness.

Evaluation Example 2

XRD patterns and scanning electron microscope images were evaluated at different content ratios of the NdFeB magnet powders and $NdH_2$ powders.

Figure 3:
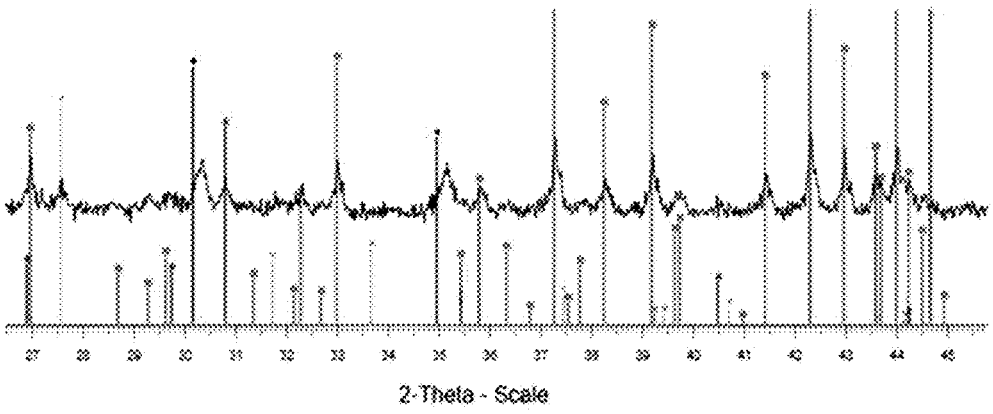
FIG. 3 and FIG. 4 respectively illustrate an XRD pattern and a scanning electron microscope image of NdFeB-based magnet powders and $NdH_2$ powders at different content ratios.
Figure 3:
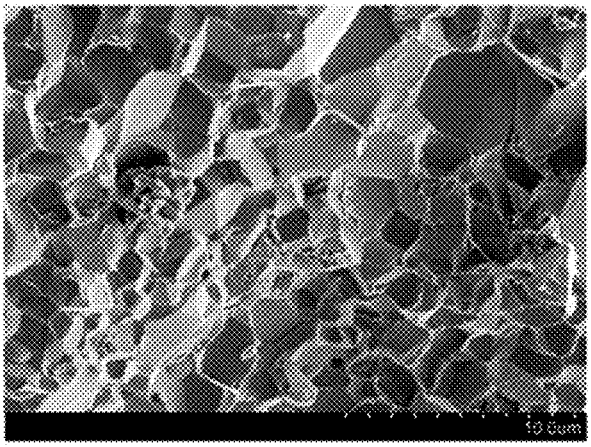

FIG. 3 illustrates an XRD pattern and a scanning electron microscope image when 25% of $NdH_2$ is contained. Referring to FIG. 3, it can be seen that when 25% of $NdH_2$ is contained, no alpha-Fe peak is observed, so the NdFeB main phase decomposition is suppressed, and it can be seen that a dense sintered magnet is formed even in a scanning electron microscopic image.

Figure 4:
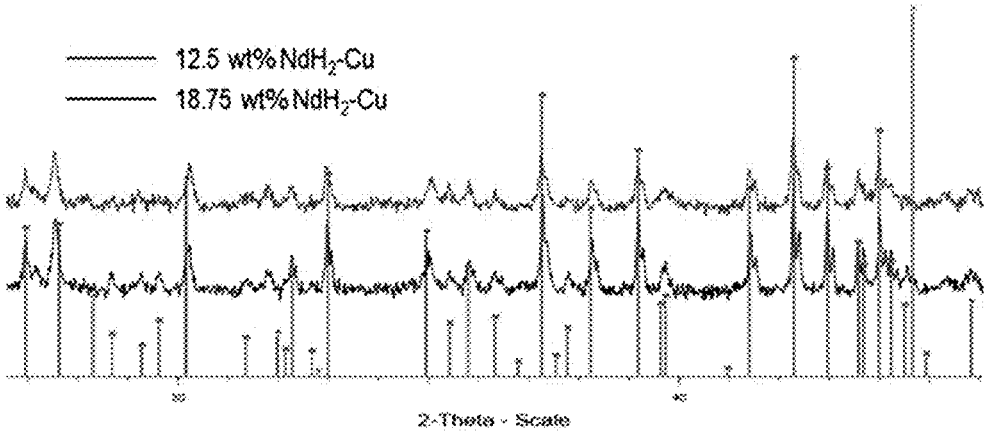
Figure 4:
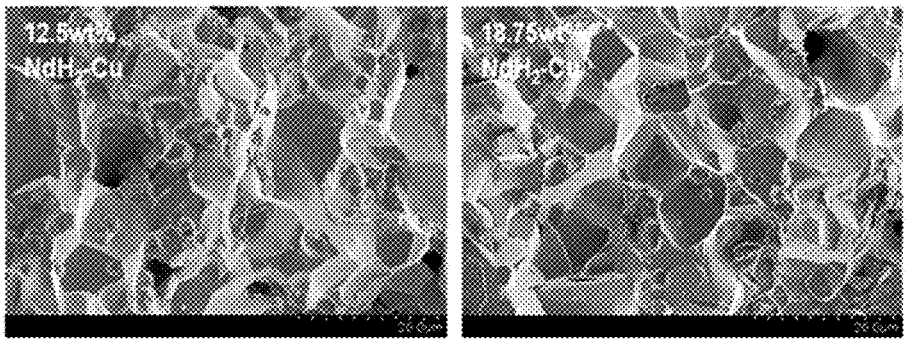

FIG. 4 illustrates a result of using powders in which $NdH_2$ and Cu are mixed at a ratio of 7:3 instead of $NdH_2$. Referring to FIG. 4, in this case, it can be confirmed that no alpha-Fe peak is observed, similar to FIG. 1 and FIG. 3. As a result, it can be confirmed that the NdFeB main phase decomposition is suppressed. It can be confirmed from the scanning electron microscope image that a size of the crystal grains is observed to be larger than a case of using single $NdH_2$ powders, and grain coarsening is achieved by promoting the sintering of the NdFeB particles while making a Nd—Cu eutectic fusion alloy.

It can be confirmed through the result of Evaluation Example 2 that the NdFeB main phase decomposition is suppressed and the sinterability is improved even when the content of $NdH_2$ is changed or the mixture with Cu is used within a description range of the present invention.

Evaluation Example 3

Figure 5:
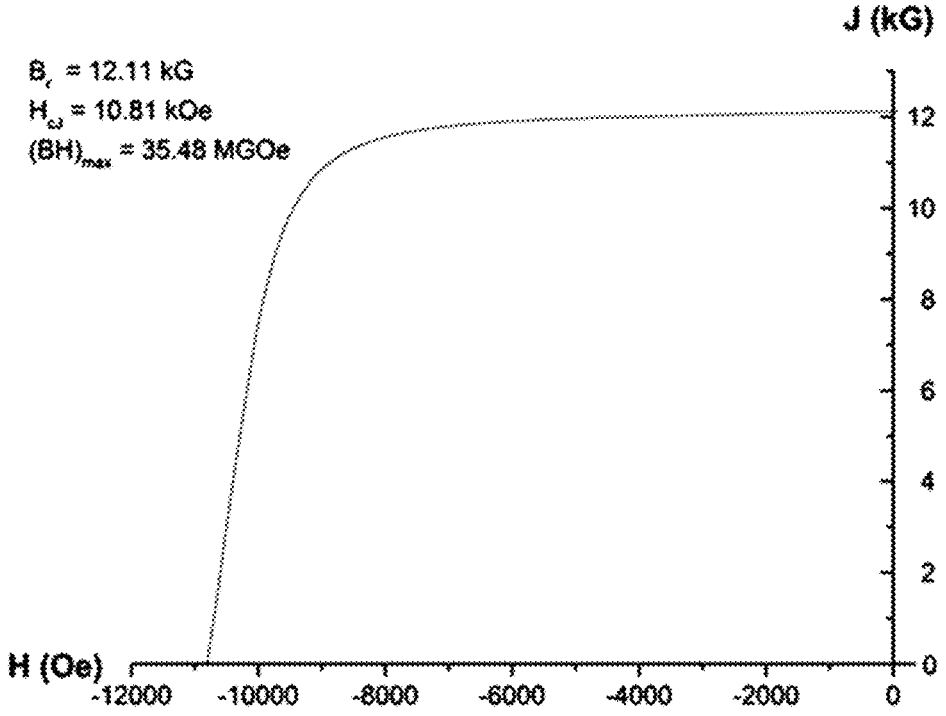
FIG. 5 illustrates measurement results of coercive force, residual magnetization, and $BH_{max}$ of a sintered magnet manufactured by setting a content ratio of $NdH_2$ to be 10 wt %.

Coercive force (Br), residual magnetization ($H_{cj}$), and $(BH)_{max}$ of the sintered magnet manufactured through Example 2 are measured and are illustrated in FIG. 5.

10 wt % of $NdH_2$ is added into NdFeB-based magnetic powders to be sintered, the residual magnetization value is 12.11 kG, the coercive force is 10.81 kOe, and the BH max value is 35.48 MGOe (megagauss oersteds).

Evaluation Example 4

Figure 6:
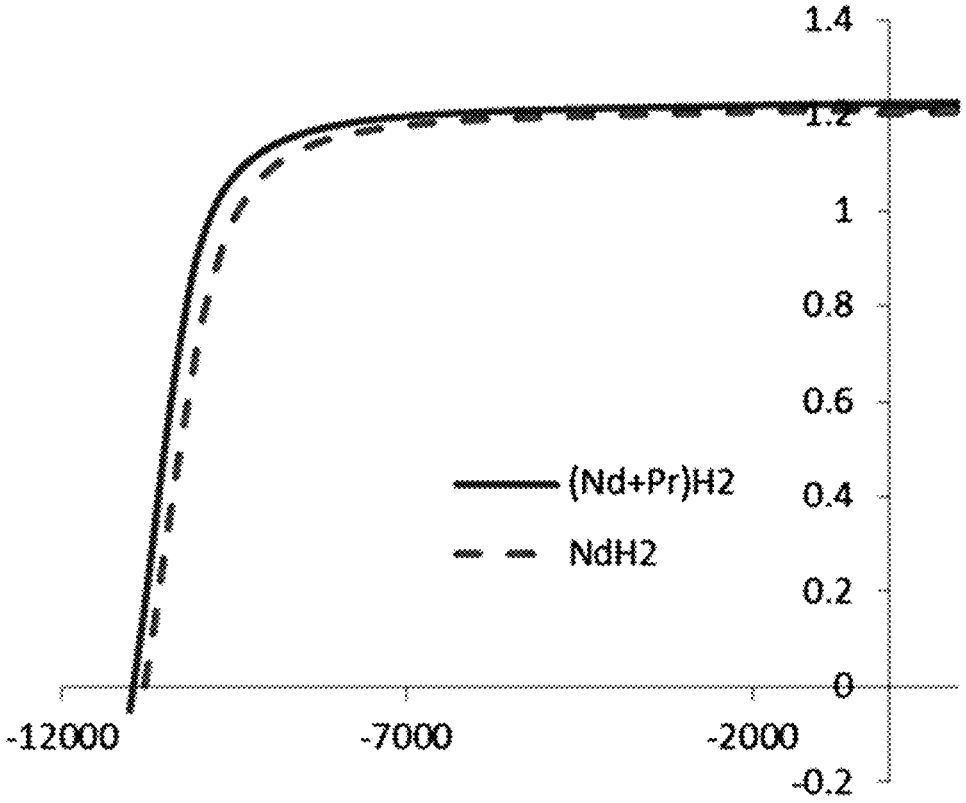
FIG. 6 illustrates BH measurement results of sintered magnets manufactured in Examples 4 and 5.
Figure 7:
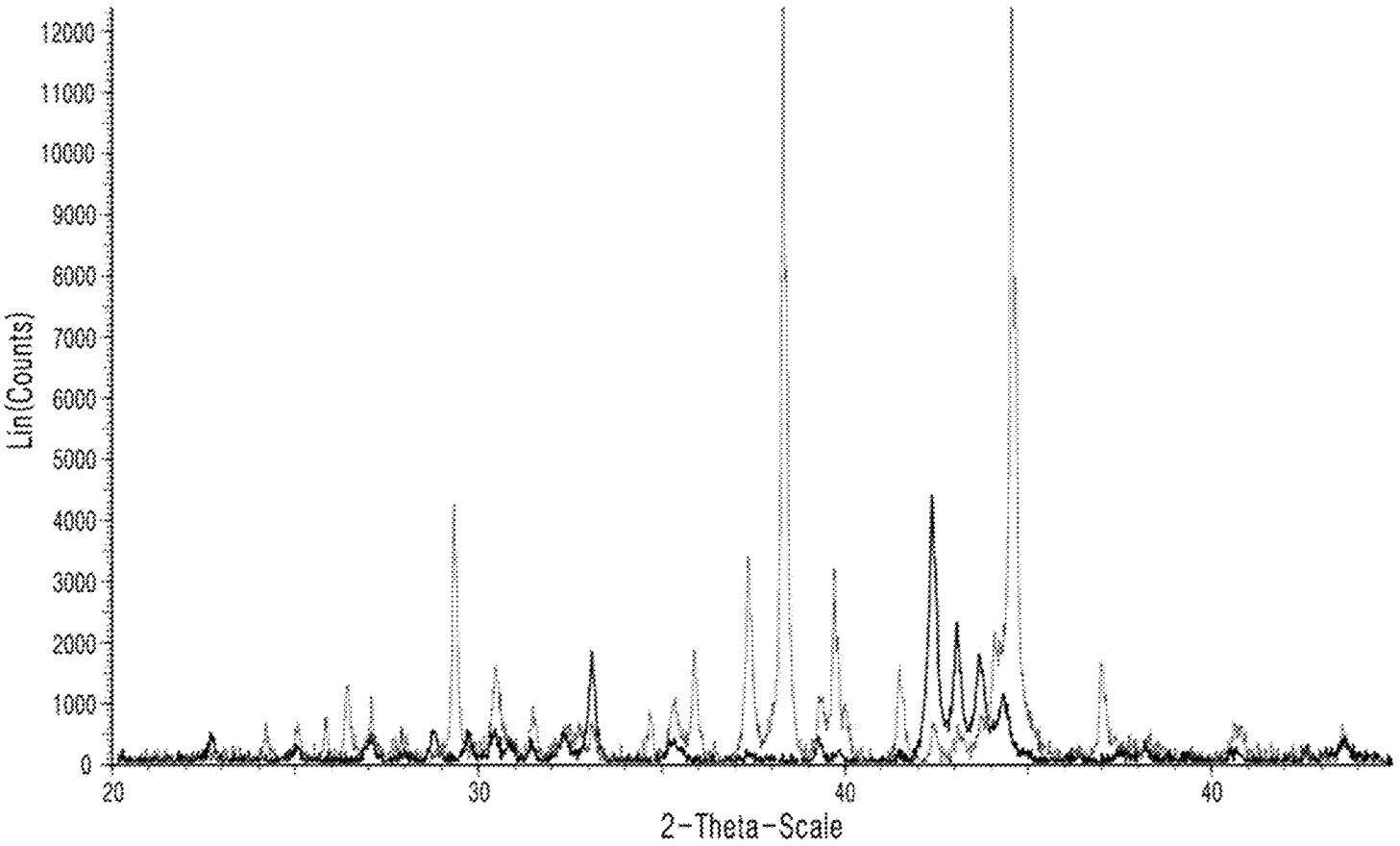
FIG. 7 illustrates an XRD result of the sintered magnet manufactured through Example 4.
Figure 8:
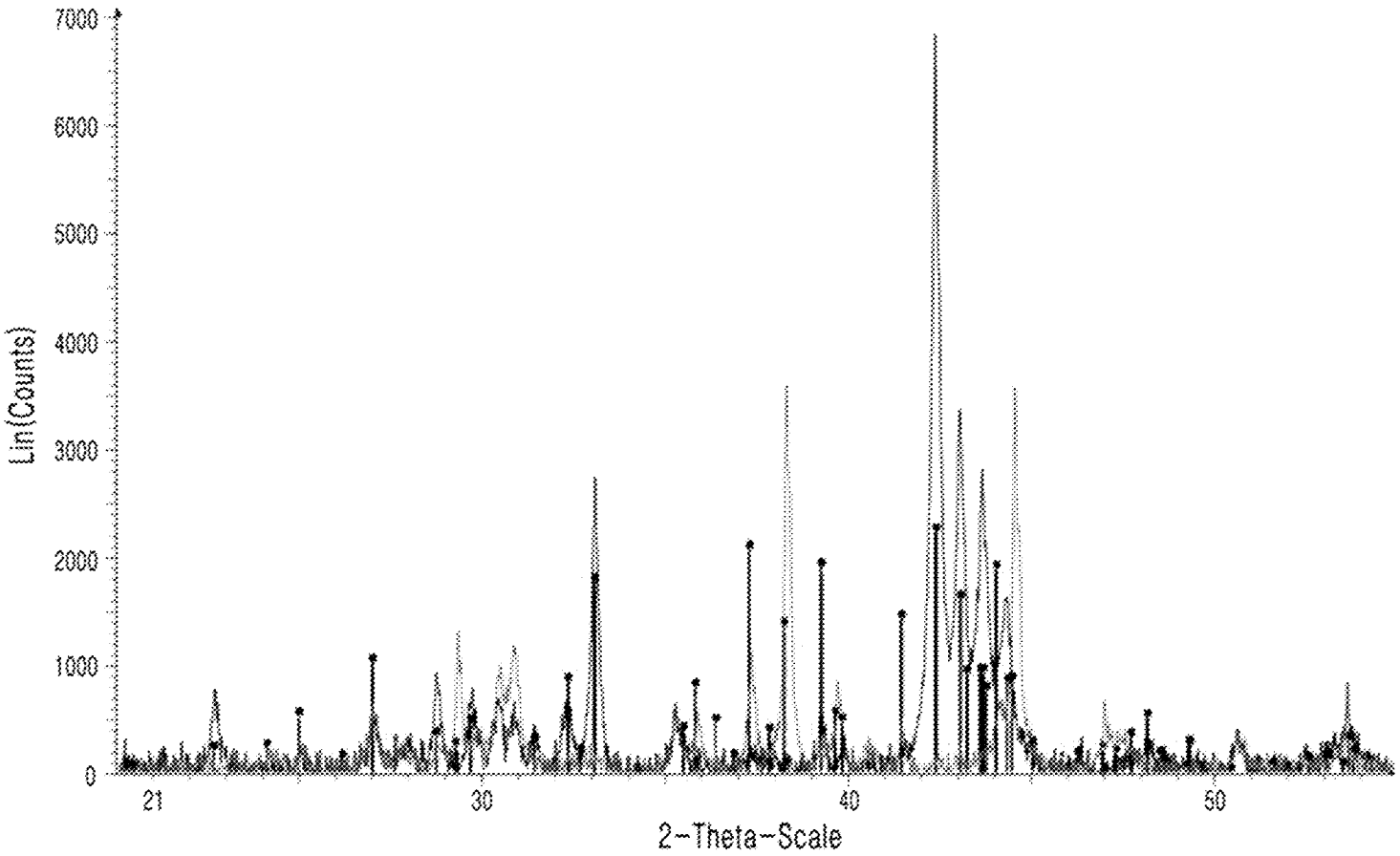
FIG. 8 illustrates an XRD result of the sintered magnet manufactured through Example 5.

BH of the sintered magnets manufactured in Examples 4 and 5 are measured and are illustrated in Table 1 and FIG. 6. XRD results of the sintered magnets manufactured through Examples 4 and 5 are illustrated in FIG. 7 and FIG. 8. FIG. 7 illustrates an XRD result of the sintered magnet manufactured through Example 4, and FIG. 8 illustrates an XRD result of the sintered magnet manufactured through Example 5.

TABLE 1

| | Example 4<br>10 wt % (Nd + Pr)$H_2$ | Example 5<br>10 wt % $NdH_2$ |
|---|---|---|
| $B_r$ | 12.24 kG | 12.11 kG |
| $H_{cj}$ | 10.97 kOe | 10.81 kOe |
| $(BH)_{max}$ | 36.40 MGOe | 35.48 MGOe |

Evaluation Example 5

Figure 9:
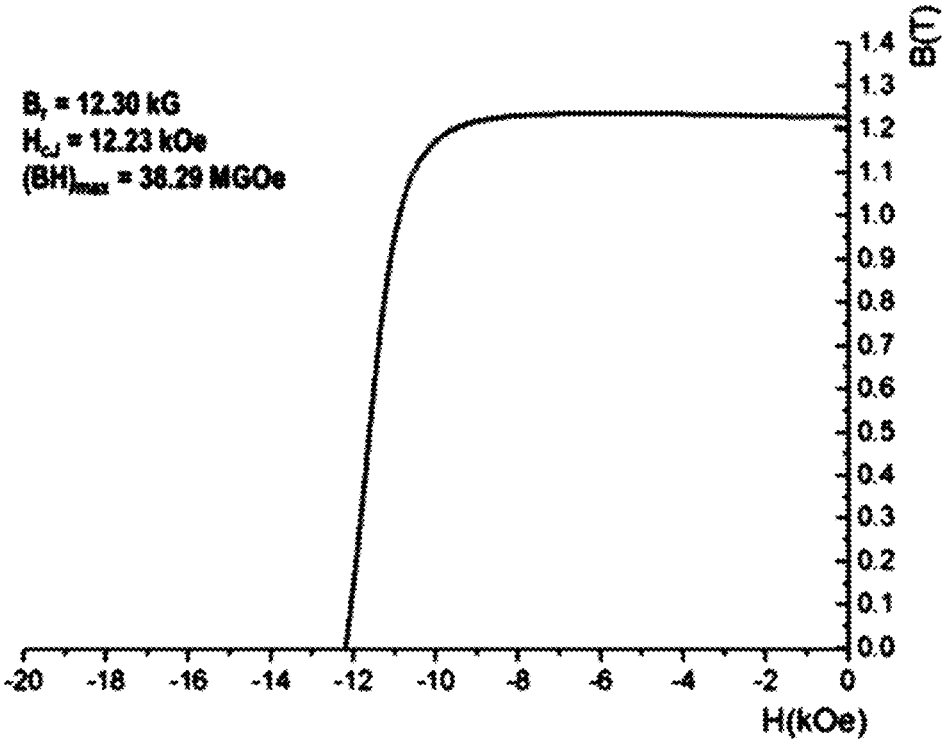
FIG. 9 illustrates a BH measurement result of a sintered magnet manufactured in Example 6.
Figure 10:
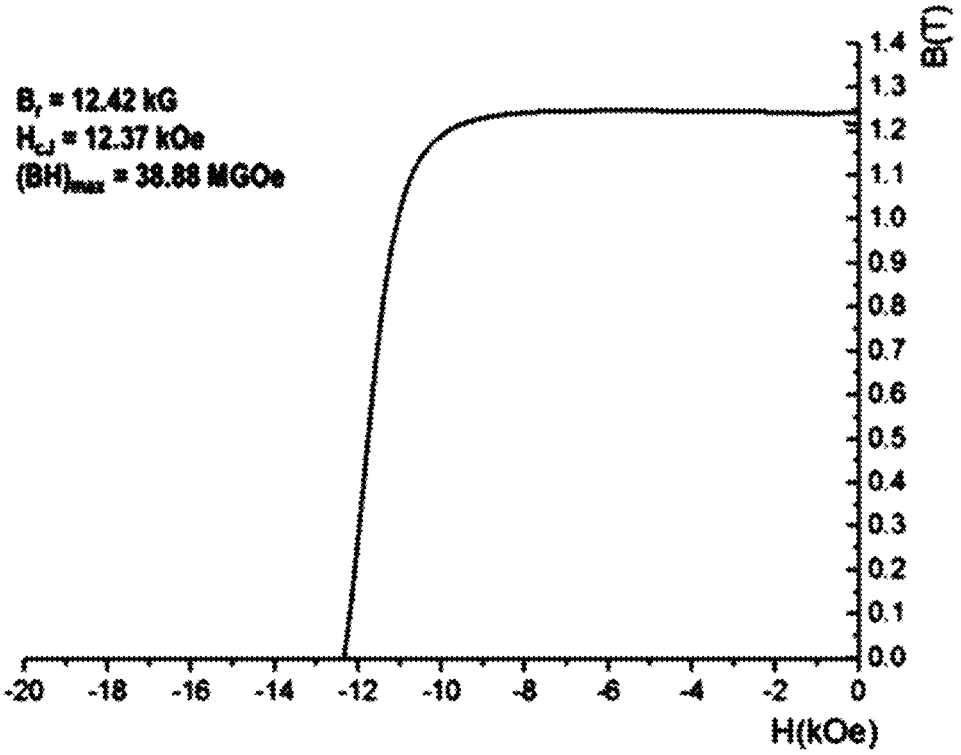
FIG. 10 illustrates a BH measurement result of a sintered magnet manufactured in Example 7.
Figure 11:
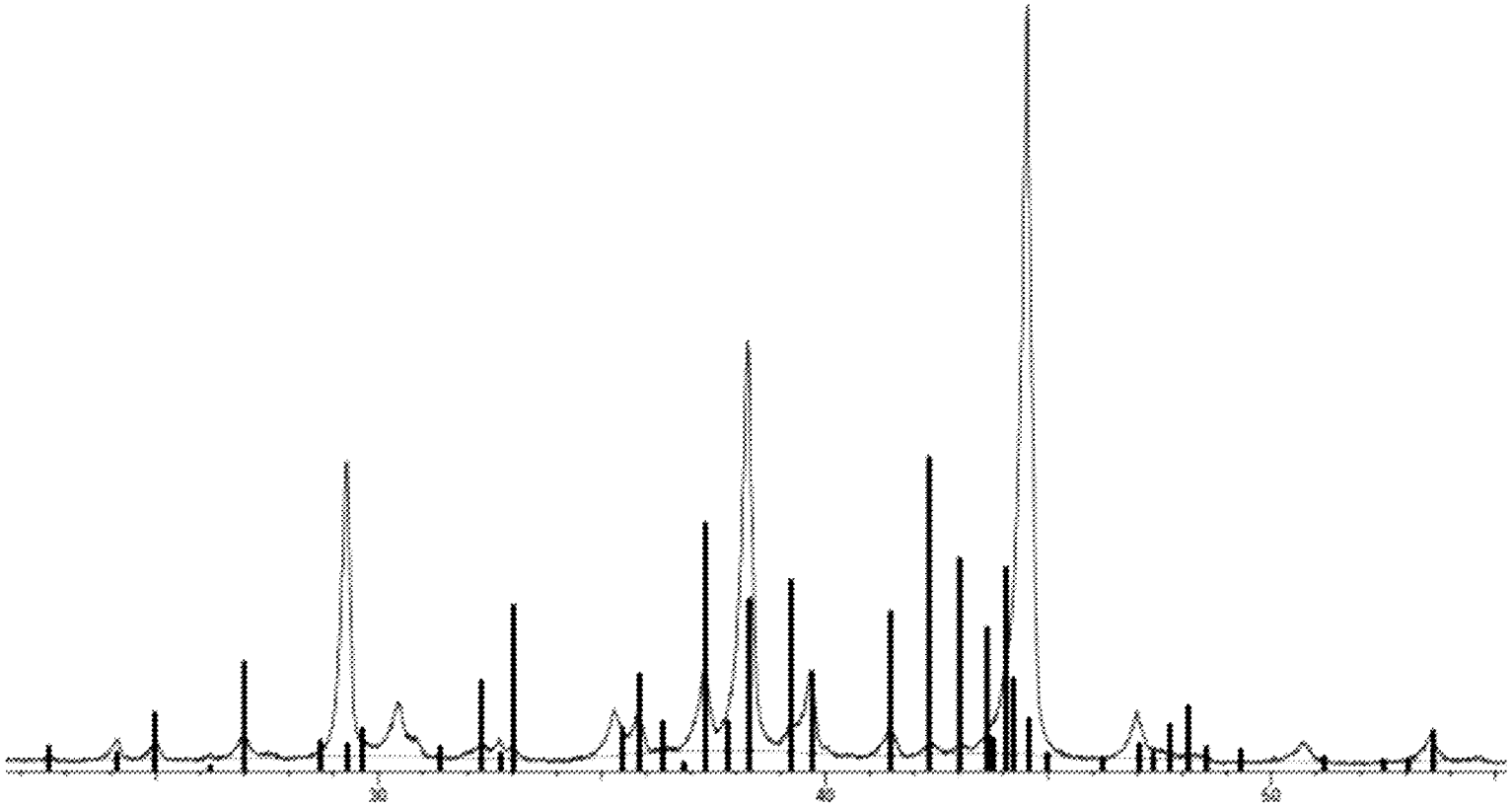
FIG. 11 illustrates an XRD result of the sintered magnet manufactured through Example 6.
Figure 12:
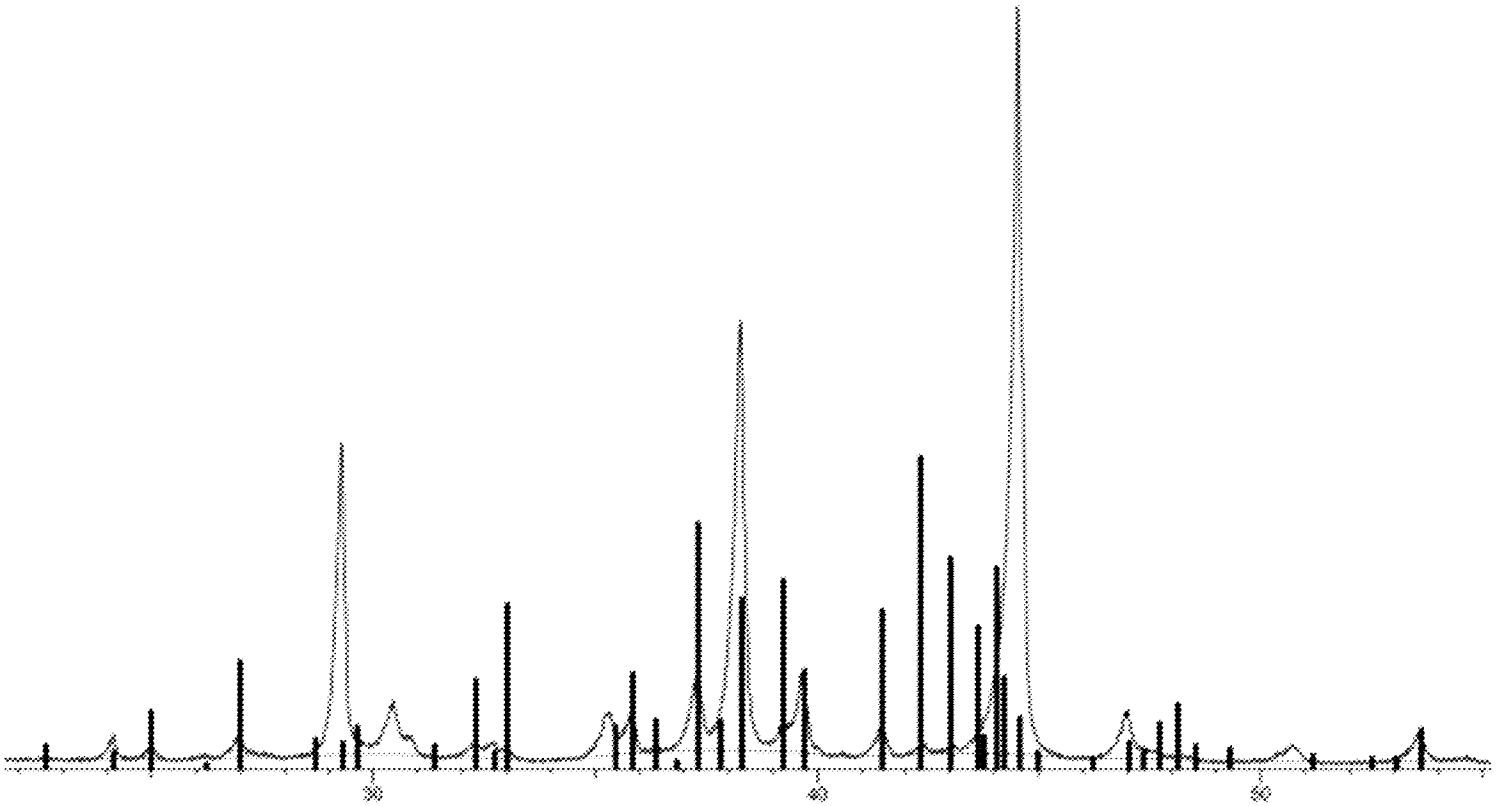
FIG. 12 illustrates an XRD result of the sintered magnet manufactured through Example 7.

BH of the sintered magnets manufactured in Examples 6 and 7 are measured and are illustrated in Table 2 and FIG. 9 and FIG. 10. FIG. 9 corresponds to Example 6, and FIG. 10 corresponds to Example 7. XRD results of the sintered magnets manufactured through Examples 6 and 7 are illustrated in FIG. 11 and FIG. 12. FIG. 11 illustrates an XRD result of the sintered magnet manufactured through Example 6, and FIG. 12 illustrates an XRD result of the sintered magnet manufactured through Example 7.

Thus, within the scope of the present invention, it is possible to confirm that it has an excellent effect even at different contents of $NdH_2$.

TABLE 2

| | 3 wt % $NdH_2$ | 5 wt % $NdH_2$ |
|---|---|---|
| $B_r$ | 12.30 kG | 12.42 kG |
| $H_{cj}$ | 12.23 kOe | 12.37 kOe |
| $(BH)_{max}$ | 38.29 MGOe | 38.88 MGOe |

As described above, the manufacturing method according to the present disclosure improves sinterability of the prepared magnet powders and suppresses decomposition of main phase particles in the sintering process by mixing the NbFeB-based powders prepared by using the reduction-diffusion method with the $NdH_2$ powders, and heat-treating and sintering the mixture. Accordingly, when a magnet is manufactured by sintering magnet powders, it is possible to prevent main phase decomposition inside the magnet powders.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A manufacturing method of a sintered magnet, the method comprising:

mixing neodymium iron boron (NdFeB)-based powders and rare-earth hydride powders to prepare a mixture;

heat-treating the mixture at a temperature of 600 to 850° C. for a time period sufficient to separate the rare-earth hydride powders into rare earth metals and hydrogen ($H_2$) gas and to remove the $H_2$ gas; and then sintering the heat-treated mixture at a temperature of 1000 to 1100° C. to prepare the sintered magnet, wherein the rare-earth hydride powders are neodymium hydride ($NdH_2$) powders or mixed powders of $NdH_2$ and praseodymium hydride ($PrH_2$).

2. The manufacturing method of claim 1, wherein the mixed powers of $NdH_2$ and $PrH_2$ have a mixing weight ratio in a range of 75:25 to 80:20.

3. The manufacturing method of claim 1, wherein the sintering of the heat-treated mixture at the temperature of 1000 to 1100° C. is performed for 30 min to 4 h.

4. The manufacturing method of claim 1, wherein, prior to the heating-treating of the mixture, the rare-earth hydride powders are present in the mixture in a range of 1 to 25 wt %.

5. The manufacturing method of claim 1, wherein a size of the crystal grains of the sintered magnet is 1 to 10 μm.

6. The manufacturing method of claim 1, wherein, the mixing of the NdFeB-based powders and the rare-earth hydride powders further comprises mixing Cu powders with the NdFeB-based powders and the rare-earth hydride powders to prepare the mixture.

7. The manufacturing method of claim 6, wherein, prior to heat-treating the mixture, the rare earth hydride powders and the Cu powders are present in the mixture in a weight ratio of 7:3.

8. The manufacturing method of claim 1, wherein, prior to mixing, the NdFeB-based powders are prepared by a reduction-diffusion method comprising:

preparing a first mixture by mixing a neodymium oxide, boron, and iron;

preparing a second mixture by adding calcium to the first mixture and mixing them; and heating the second mixture to a temperature of 800 to 1100° C. to prepare the NdFeB-based powders.

* * * * *